United States Patent [19]

Goller et al.

[11] Patent Number: 4,503,690

[45] Date of Patent: Mar. 12, 1985

[54] FABRIC TAKE-DOWN MECHANISM FOR FLAT KNITTING MACHINES

[75] Inventors: Ernst Goller, Reutlingen; Fritz Walker, Kusterdingen, both of Fed. Rep. of Germany

[73] Assignee: H. Stoll GmbH and Company, Reutlingen, Fed. Rep. of Germany

[21] Appl. No.: 517,721

[22] Filed: Jul. 27, 1983

[30] Foreign Application Priority Data

Aug. 4, 1983 [DE] Fed. Rep. of Germany ..... 3229032

[51] Int. Cl.[3] ..... D04B 15/88

[52] U.S. Cl. ..... 66/149 R; 66/150; 66/147

[58] Field of Search ..... 66/149, 150, 147

[56] References Cited

U.S. PATENT DOCUMENTS

| | | | |
|---|---|---|---|
| 3,375,685 | 4/1968 | Joseph | 66/150 |
| 3,376,716 | 4/1968 | Joseph | 66/150 |
| 3,618,343 | 11/1971 | Essig | 66/150 |

FOREIGN PATENT DOCUMENTS

| | | | |
|---|---|---|---|
| 1947007 | 9/1969 | Fed. Rep. of Germany | 66/149 R |
| 2427117 | 1/1976 | Fed. Rep. of Germany | 66/149 R |
| 1254540 | 11/1971 | United Kingdom | 66/149 R |

*Primary Examiner*—Ronald Feldbaum
*Assistant Examiner*—Mary A. Ellis
*Attorney, Agent, or Firm*—Larson and Taylor

[57] ABSTRACT

In a fabric take-down mechanism for a flat knitting machine provided with stitch strippers, the edge of the fabric disposed in front of the stitch strippers is engaged by a plurality of take-down hooks (27) of a hook bar (28) located beneath the comb gap (13) defined by the ends of the needle beds (10 and 11). The engagement of the fabric edge is produced by a free fall of the take-down hooks (27) over a limited initial length of take-down travel (A). The take-down of the fabric by the take-down hooks (27) is effected synchronously with the movement of a succeeding take-down roller (13) in the effective area of which the edge of the fabric is carried by means of the take-down hooks (27).

8 Claims, 2 Drawing Figures

FABRIC TAKE-DOWN MECHANISM FOR FLAT KNITTING MACHINES

FIELD OF THE INVENTION

This invention relates to a fabric take-down mechanism for flat knitting machines provided with stitch-stripping devices.

BACKGROUND OF THE INVENTION

It is already known to engage the leading part of a fabric on a flat knitting machine by take-down hooks, and to pull it by means of these hooks into the area of a take-down roller, which then performs the further taking down of the fabric. An apparatus of this nature is known through German Pat. No. 1,270,730 and the equivalent British Pat. No. 968,001 of the applicants. In this known arrangement the take-down hooks are arranged on a needle bar at the same interval as those on the needle beds and the gaps for the needles. During the formation of the initial path of the knitted fabric, the take-down hooks are raised between the needles and knitted with the yarn. This has the drawback that the take-down hooks must be accurately positioned and so arranged that they can be taken in batches or can be laterally offset. During the production of shaped knitted pieces connected to one another, the take-down needle bar may be so prepared that, in the area in which the successive shaped parts are connected to one another, no take-down hook can be present. Instead the bar is located only in the subsequent free marginal part of a succeeding fresh shaped fabric or shaped article.

SUMMARY OF THE INVENTION

It is an object of the present invention to devise a simpler auxiliary take-down device for the initial part of a knitted fabric or a knitted fabric part itself. It is also an object to eliminate a separation or lateral offsetting of the take-down hooks to suit the knitted transition part.

These objects are met in the present invention in a fabric take-down mechanism of the kind set forth in the aforementioned patents. According to the present invention, a prior art flat knitting machine is provided with stripping devices that advantageously utilize the means for driving a hook bar provided with a plurality of attached hooks normally disposed in the take-down direction, for a synchronous movement with the take-down roller, to permit also a rapid initial movement of the hook jacks for a limited initial path of the take-down movement.

The rapid movement can be produced by permitting a free fall of the hook bar which is detached from the drive during the initial part of the travel.

Mechanisms according to one embodiment of the present invention comprise at least one driven, take-down roller and a hook bar, adapted to be raised and lowered and having controlling drive means.

In the case of a fabric take-down mechanism constructed in accordance with the present invention, the take-down hooks no longer need to be moved upwards between the needles and engaged by the marginal stitches of the fabric. Instead, the fabric is passed into the comb gap between the needle beds by means of the needle strippers, and the take-down hooks engage the edge of the fabric only beneath the needle beds. This avoids the necessity for having accurate spacing between the take-down hooks and allows the use of a smaller number of take-down hooks than needles in the individual needle beds. The hook jacks can be anchored firmly in the hook bar and the hook jacks can uniformly be provided on the hook bar over the complete length of the needle beds. This can be accomplised because hook jacks can be provided in the take-down mechanism according to the invention without an offset, even at the transition area between shaped knitted parts.

A counter bracket can extend parallel to the needle beds and to the needle bar beneath the comb gap between the needle beds, and can cooperate with the take-down hooks in their upper, engagement position. The counter bracket can, for example, consist of a spiked or barbed roller displaceable parallel to the needle beds. As a result of the free fall of the hook bar in the initial starting section, the edge of the fabric brought by the stitch strippers into the area of the upper part of the take-down hooks can be positively engaged by the take-down hooks. These hooks move the edge of the fabric synchronously downwardly to the take-down roller that is disposed therebelow. The roller then engages the edge of the fabric and strips it from the take-down hooks. The drive of the hook bar can be coupled with the take-down roller through a non-slip clutch with the driving means, preferably a rotary field magnet drive.

DETAILED DESCRIPTION OF THE PREFERRED EMBODIMENT

Figure 1:
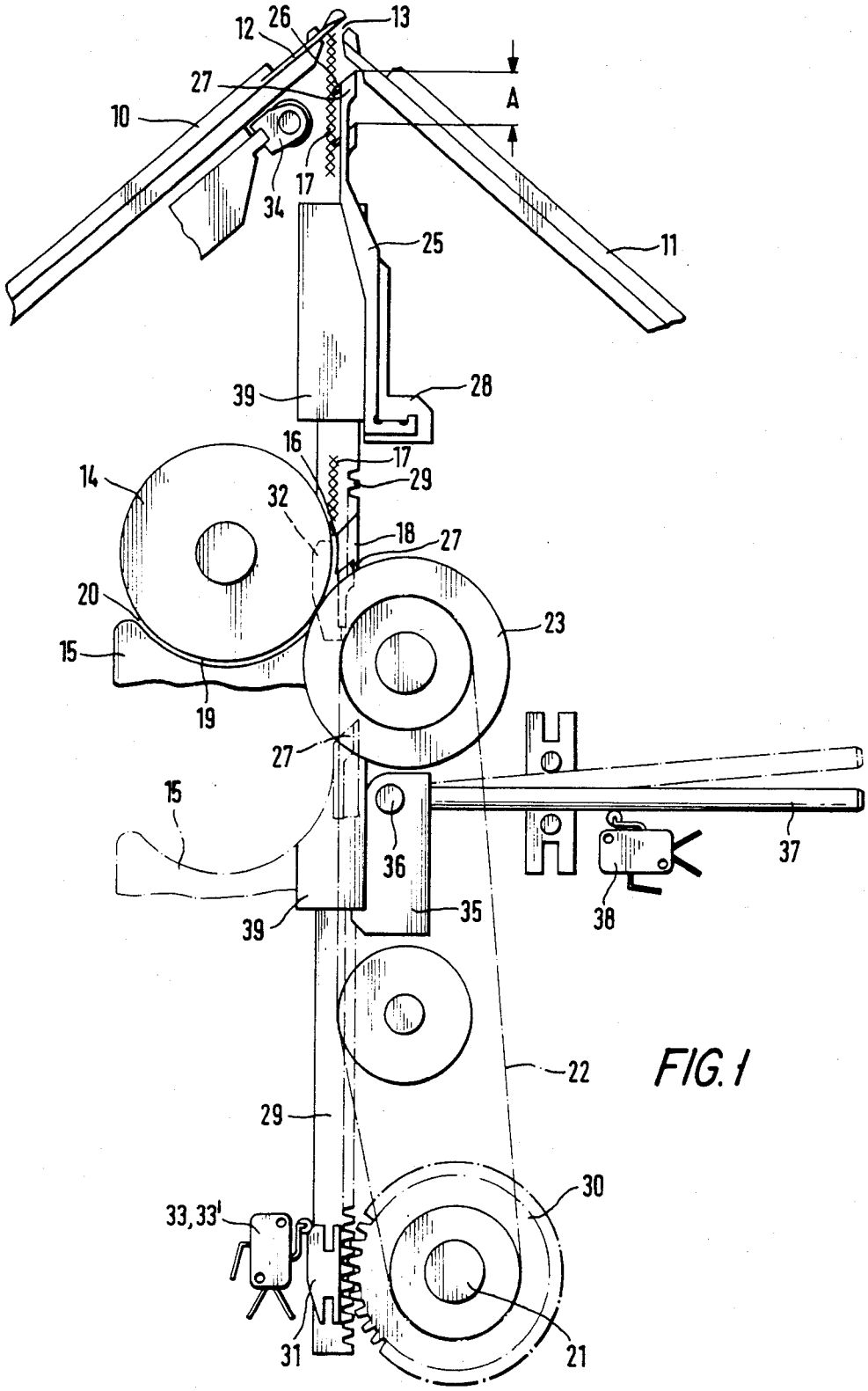
FIG. 1 is a highly diagrammatic representation taken in a cross-sectional plane of a flat knitting machine according to the present invention.
Figure 2:
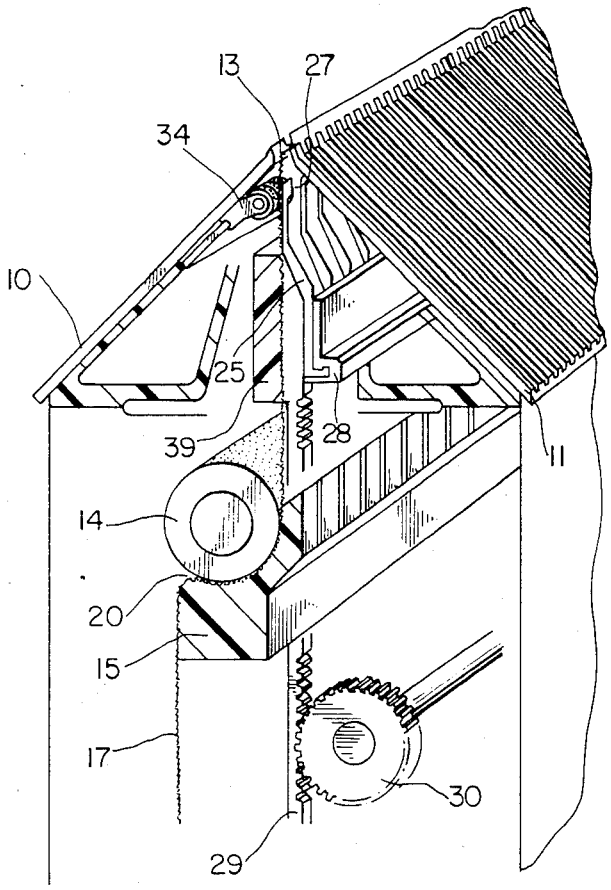
FIG. 2 is a diagrammatic perspective view partially in section, of the knitting machine depicted in FIG. 2.

The diagrammatic drawings show two needle beds 10 and 11 of a flat knitting machine. Each bed 10 or 11 has latch needles 12 mounted therein for longitudinal displacement. The ends of needles 12 of beds 10 and 11 are horizontally spaced apart and together define a comb gap 13.

Spaced beneath the two needle beds 10 and 11 is a fabric take-down mechanism of known form. The mechanism comprises a take-down roller 14 operated by a rotary field magnet (not shown). Roller 14 cooperates with a shell-type guide member 15 which terminates in a comb bar 18 at an entrance or inlet part 16 for the knitted fabric 17. The shell guide member 15 with its comb bar 18 and the take-down roller 14 together define between them a take-down passage or channel 19 having an upper inlet part 16 and a lower outlet part 20. The rotary field magnet that directly drives roller 14 also drives a shaft 21 through an intermediate wheel 23 and a toothed belt 22.

The auxiliary take-down mechanism of the present invention comprises a hook bar 28 made of light aluminum. Hook bar 28 extends over the complete transverse length of needle beds 10 and 11, and is equipped with vertically extending hook jacks 25. Steel pins 26 are inserted into the upper ends of hook jacks 25 at an oblique downward angle and the tips of pins 26 constitute take-down hooks 27. Hook bar 28 is connected to guide rails and racks 29. The racks 29 engage toothed wheels or pinions 30, which are coupled through a non-slip toothed clutch (not shown) with the drive shaft 21 of the fabric take-down mechanism. As a result of the intrinsic weight of the hook bar 28 and the hook jacks 25 balanced by a weight (not shown), the take-down effect of the rotary field magnet is sufficient on its own.

Secured at each end of one rack 29 are two switch cams, lower and upper switch cams 31 and 32, which cooperate with corresponding electrical end switches 33 and 33'. The upper switch cam 32, which acts on the end switch 33' (masked in the drawing), controls the toothed clutch operating the driving toothed pinion 30. The lower switch cam 31 with the end switch 33 limits the upward travel of the hook bar 28.

In the drawings, rack 29 and hook jacks 25 are shown in their uppermost positions in which the take-down hooks 27 are disposed closely beneath the comb gap 13 between the needle beds 10 and 11. The initial part of the knitted fabric 17 is pressed by means of push-out members (not shown) in a known fashion through the comb gap 13 until this initial part reaches the area of take-down hooks 27 when disposed in their uppermost position. Before the take-down hooks 27 engage the beginning of a knitted fabric or knitted transfer section, a spiked or barbed roller 34, extending parallel to the needle bed 10, is moved parallel to needle bed 10 from the rest position shown in FIG. 1 to the right against the fabric 17.

At the beginning of the descent of hook bar 28, the electrical toothed clutch for driving wheel 30 is shut off through the operation of the device (not shown in detail) for moving hook jacks 25. The effect of the aforementioned balance weight is eliminated so that hook jacks 25 with hook bar 28 and the vertical guide rails and racks 29 are permitted to drop under their own weight through a short initial path of travel, depicted in FIG. 1 as a vertical distance A. As a result of this initial drop or free travel, the take-down hooks 27 drop into the part of the fabric 17 that has been fed through comb gap 13. During the initial travel of distance A, the hook jacks 25 also undergo a small transverse movement in the direction of fabric 17 as a result of the effect of the guide means. The length of distance A is determined by the non-engagement of the balance weight plus a reserved distance. After the hook jacks 25, hook bar 28 and guide rails and rack 29 have fallen through distance A, the electrical toothed clutch for wheel 30 is restarted by the electrical control. There now follows a further synchronous take-down motion of the hook jacks 25 with the take-down roller 14 until the second switch cam 32 reaches the end switches 33 and 33', whereupon the drop of hook bar 28 is terminated. The take-down hooks 27 are then located between the teeth of the comb bar 18 of shell guide 15 in inlet part 16 of take-down channel 19.

The start of the knitted fabric or the interim part of connected fabrics has been tightened by take-down hooks 27 and is now introduced into the take-down channel 19 by take-down hooks 27 where the material is engaged by take-down roller 14. Take-down roller 14 is provided with a gripping surface covering that engages the fed material and conducts it through passage 19.

In the lower end position of racks 29, a pawl 35 engages a guide piece 39 connected to one of the racks 29. Pawl 35 is pivotally mounted on a pin 36 and a hand lever 37 is attached to either pin 36 or pawl 35. A microswitch 38 engages and is operated by the positioning of hand lever 37. By lifting hand lever 37, pawl 35 can be released and the machine positively cut out through microswitch 38. In this position hook bar 28 and shell guide member 15 can drop together.

The hook bar 28 with its hook jacks 25 and the take-down hooks 27 can be moved back to their upper starting position from their lower position by roller 14 during the take-down of the knitted fabric 17.

We claim:

1. A fabric take-down mechanism for a flat knitting machine having stitch-stripping devices, the machine including first and second needle beds spaced longitudinally apart at their respective ends to define a comb gap, each bed having a plurality of transversely spaced apart needles, the mechanism comprising at least one driven take-down roller mounted spaced below said comb gap, a hook bar adapted to be raised and to be lowered in a take-down direction;

controllable drive means for controlling the raising and lowering of said hook bar;

take-down hooks mounted on said hook bar for engaging a knitted fabric in the space between the needle beds and said take-down roller, such that in the uppermost position of said hook bar, said take-down hooks are disposed beneath the comb gap and during the downwards movement of said hook bar, said hooks hang into the edge of the fabric.

2. A fabric take-down mechanism as claimed in claim 1 and further including a plurality of hook jacks mounted on said hook bar and mounting in turn said take-down hooks; and wherein said drive means is also for providing a synchronous movement of said hook bar with said take-down roller and is further for permitting an initial rapid movement of said hook jacks for a limited initial distance in said take-down direction.

3. A fabric take-down mechanism as claimed in claim 2 wherein said rapid movement is produced by a free fall of said hook bar resulting from a detachment of said drive means from said hook bar during an initial time period sufficient to allow said initial movement.

4. A fabric take-down mechanism as claimed in claim 1 wherein said hook bar extends over the complete length of the needle beds.

5. A fabric take-down mechanism as claimed in claim 1 wherein said take-down hooks are spaced from one another by an amount independent of the needle spacing in the needle beds.

6. A fabric take-down mechanism as claimed in claim 1 and further including a bracket disposed beneath the comb gap parallel to one of the needle beds and to the hook bar.

7. A fabric take-down mechanism as claimed in claim 6 wherein said bracket comprises a barbed roller mounted for displaceable movement parallel to the one needle bed.

8. A fabric take-down mechanism as claimed in claim 1 and further including means for latching said hook bar in the lowermost position thereof such that said take-down hooks are in the region of said take-down roller.

* * * * *